US007547248B2

(12) United States Patent
Enomoto

(10) Patent No.: US 7,547,248 B2
(45) Date of Patent: Jun. 16, 2009

(54) DISK DISPENSING APPARATUS WITH EJECTOR UNIT

(75) Inventor: Minoru Enomoto, Saitama (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 128 days.

(21) Appl. No.: 11/675,581

(22) Filed: Feb. 15, 2007

(65) Prior Publication Data

US 2007/0207717 A1 Sep. 6, 2007

(30) Foreign Application Priority Data

Feb. 16, 2006 (JP) ..... 2006-039848

(51) Int. Cl.
*G07D 1/00* (2006.01)

(52) U.S. Cl. ..... 453/54; 453/50

(58) Field of Classification Search ..... 453/18, 453/39–41, 43, 44, 50–54; 194/202, 215, 194/216, 217, 302, 317; 73/163
See application file for complete search history.

(56) References Cited

U.S. PATENT DOCUMENTS

| | | | | |
|---|---|---|---|---|
| 6,059,651 | A * | 5/2000 | Abe et al. | 453/50 |
| 6,599,181 | B2 | 7/2003 | Abe et al. | |
| 7,172,503 | B2 | 2/2007 | Umeda | |
| 2002/0193062 | A1 * | 12/2002 | Abe et al. | 453/41 |
| 2005/0176359 | A1 | 8/2005 | Umeda | |

* cited by examiner

*Primary Examiner*—Patrick Mackey
*Assistant Examiner*—Mark Beauchaine

(57) ABSTRACT

A disk dispensing apparatus has an ejector unit that can be reversibly mounted at the end of a guide path so that tokens or disks can be both adjusted for different sizes while permitting the discharge of the disks in opposite directions. The guide path is also adjustable to accommodate different sized disks with a base member extending above support plates that define a transmit opening for the disk. The base member has an aperture that is operatively interfaced with a flipping roller that can propel disks at a discharge position.

11 Claims, 7 Drawing Sheets

DISK DISPENSING APPARATUS WITH EJECTOR UNIT

BACKGROUND OF THE INVENTION

1. Field of the Invention

The present invention relates to a disk dispensing apparatus which dispenses disks laterally from a distal end of a guiding path after aligning and guiding the disks on the guiding path in a state in which outer peripheral edges of the disks are brought in contact with each other. In particular, the present invention relates to a dispensing apparatus capable of changing a dispensing direction of a disk easily with an adjustable ejector unit.

2. Description of Related Art

Incidentally, the term "disk" used in this text embraces a coin which is a currency, a medal for a game machine, a token money such as a token, and things of like kind.

There has been a configuration where coins in a hopper are fed out, one by one, by a rotary disk, and then the coins are aligned and guided upward by an escalator apparatus extending vertically upward. The coins are ejected or flipped out laterally from a guiding path due to a returning force of a restricting roller in an ejecting unit provided at an exit end of the guiding path. The ejecting unit includes the restricting roller, a lever, and a spring. In the dispensing apparatus, an oscillating movement of the lever is detected by a sensor to obtain a signal of a coin dispensed. See U.S. Pat. No. 6,599,081.

Similarly, in a coin sending apparatus which ejects a coin sent by a coin feeding apparatus and guided upward on a guiding path of an escalator apparatus from a distal end thereof, there has been known a dispensing apparatus where an ejection mechanism is configured with a roller which is biased resiliently and guided linearly. In this conventional apparatus, a dispensing direction of a coin can be changed by disposing a position of the roller on the right or the left to be shifted with respect to the guiding path. Reference can be made to U.S. Pat. No. 7,172,503.

In a case of changing a coin exit from a left-facing to, for example, right-facing orientation, such members as a pivoting lever, a roller, and a movement hole of the roller of an ejecting unit which is positioned at an exit of a guiding path and biased to one side of the guiding path must be replaced with alternative members having shapes and structures suitable for the right-facing exit. This is because there can be a problem in that a length of the guiding path must be changed to a length corresponding to a diameter of a coin.

On the other hand, a roller which is a dispensing member at a dispensation time of a coin receives a reactive force from the coin, so that a shaft supporting the roller is brought in pressure contact with a guiding groove face. Due to repetition of this pressure contact, a recessed portion is formed on the pressure-contacting portion. For this reason, a problem could occur so that smooth dispensation cannot be continued due to the shaft caught in the recessed portion.

Accordingly, there is a demand to provide an easily adjusted and compact ejection unit that can accommodate different size disks and be adjusted to alter the dispensing direction of the disks.

SUMMARY OF THE INVENTION

The present invention has been made in view of the above-described points, and a first object thereof is to provide a disk dispensing apparatus which can continue with a smooth dispensation of disks from a guiding path.

A second object thereof is to provide a disk dispensing apparatus which can change a dispensing direction of a disk by using an ejector unit that can accommodate different ejector directions and different size disks.

The present invention is a disk dispensing apparatus which aligns and guides disks sent from a hopper, one by one on a guide path, and dispenses the disks laterally from a distal end of the guide path, including at least a guide member disposed at a distal end portion of the guide path. The guide member has a guiding face which guides a disk laterally, a disk ejecting unit disposed at an exit of the guiding path, and a dispensation detecting sensor for detecting a disk ejected or flipped out by the ejecting unit, wherein mounting portions of the guide member, the ejecting unit, and the dispensation detecting sensor can be provided on the right and left of an extension portion of the guide path.

Due to this configuration, it is possible to change a disk dispensing direction such that a left side and a right side thereof are reversed, for example, changing its structure from a rightward dispensation to leftward dispensation. Since the extension portion of the guide path has mounting portions on its right and left sides, a dispensing apparatus whose exit direction is different can be formed easily by changing positions of the guide member, an ejector mechanism, and the dispensation detecting sensor.

Since configurations regarding both right and left directions can be achieved by using the same guiding member, the same ejector mechanism, and the like, parts can be shared, which is economical. Also a fixing part, such as a screw fixing these parts can be shared, and a lesser number of parts are required. Finally, since there is not much of a difference in an assembling method between a right and left side, assembling can be performed easily.

The ejecting unit can be positioned on the front and back sides of the extension portion of the guiding path. In the present invention, the operational direction of the ejecting unit can be reversed by having the disposition of the ejecting unit switched between the front side and the back side in the extension portion of the guiding path, so that the disk can be flipped out or ejected in a desired direction.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Figure 1:
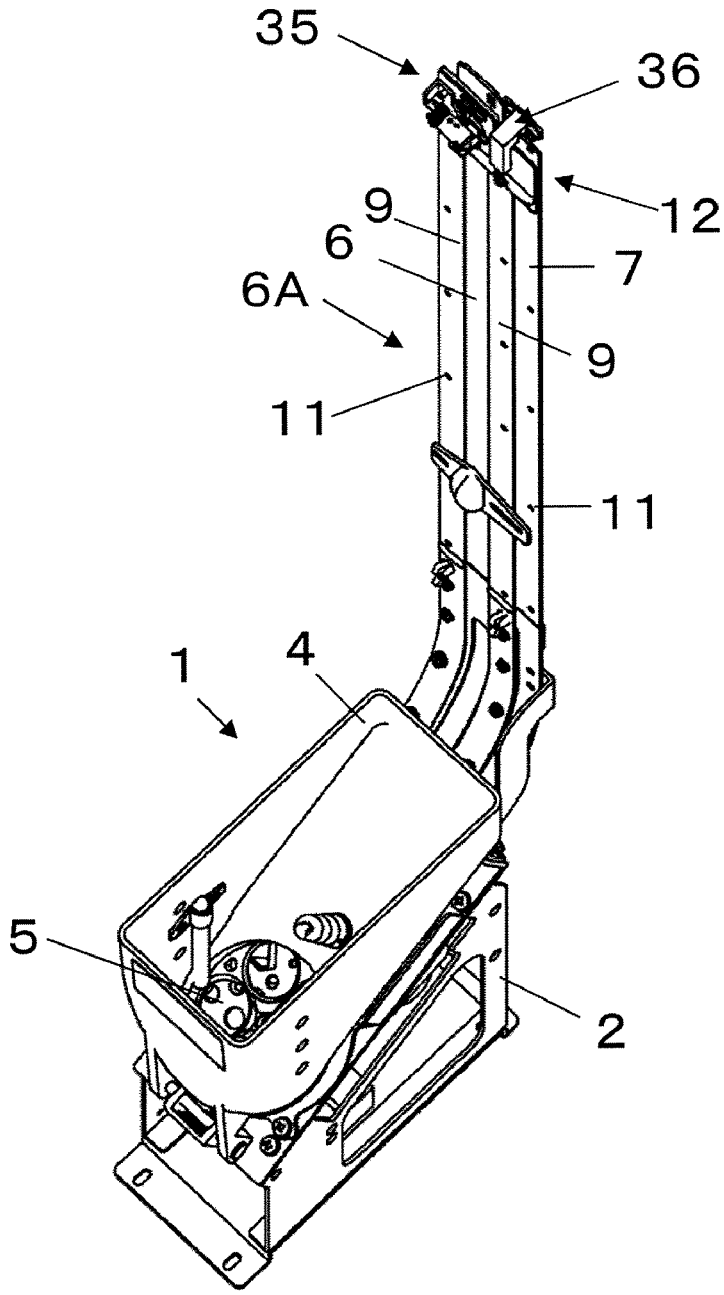
FIG. 1 is a perspective view showing a disk dispensing apparatus mounted on a disk sending unit.

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Hereinafter, a disk sending apparatus according to an embodiment of the present invention will be explained with reference to the drawings.

In these figures, a hopper 1 which is a disk sending apparatus has a frame 2. A cylindrical bowl 4 is fixed on the frame 2 and retains or stores disks 3. A rotary disk 5 rotates in a bottom portion of the bowl 4 for selectively sending out the disk 3.

In the hopper 1, a guiding apparatus 6A which aligns and guides disks 3, sent out by the rotary disk 5, is connected to the frame 2 so as to extend upward. A guide path 6, occupying a space for one disk, is formed inside the guide apparatus 6A. The guide path 6 has a vertically elongated rectangular base 7, a pair of long and thin plate-like spacers 8*a* and 8*b* which are slightly thicker than the disk 3, and a pair of support plates 9 and 9 for the spacers 8*a* and 8*b*. These elements collectively provide the escalator guide path.

A distance between the pair of spacers 8*a* and 8*b* is slightly larger than a diameter of the disk 3. Screws 11 penetrating the support plates 9 and 9 and the spacers 8*a* and 8*b* are screwed into the base 7 to integrate them together. The guide path 6 is a space extending vertically and having a rectangular shape in cross section surrounded by the base 7, the spacers 8*a* and 8*b*, and the support plates 9 and 9.

A width of the guiding path 6 can be adjusted according to a specific diameter of the disk 3 by moving the right spacer 8*b* having a horizontally elongated hole (not shown) for width adjustment laterally to change a distance between the right opener 8*b* and the left spacer 8*a* and fixing the same on the base 7. Accordingly, different size tokens or coins can be accommodated.

An exit path 12R which dispenses disks 3 laterally from the guide path 6 is formed at an upper end of the guiding path 6. The exit path 12A is formed using the following components. For convenience of explanation, a configuration of a rightward coin dispensing with respect to the guide path 6 will be first explained.

The components are an L-shaped guide spacer 14 removably disposed at an upper end portion of the left spacer 8*a* so as to be connected to a distal end of the guiding path 6, on which a guide edge 13 curved to the right spacer 8*b* is formed. See FIGS. 2 to 4. A rightward dispensation guide 15 is disposed adjacent to the outside of the right spacer 8*b*, and forms a rolling end of the rightward exit path 12R. A guide cover 16 is put on the support plates 9 and 9 and the rightward dispensation guide 15 and mounted and fixed on the base 7. A base extension portion 7D, is a distal end of the base on which the guide spacer 14, the rightward dispensation guide 15, and the guide cover 16 are mounted and fixed, namely, it extends further beyond the guiding path 6 to be a base plate of the exit path 12R. Incidentally, the guide spacer 14 is sandwiched and fixed between the guide cover 16 and the base 7 when the guide cover 16 is mounted.

A mounting portion 21 is provided on the left side of the base extension portion 7D, and mounting portions 21 and 32 are provided on the right side opposite to the mounting portion 21. Through holes 22, 22, 31, and 31 for screws 24 and 24 for screwing a disk ejecting unit 35 (described later) are formed in the respective mounting portions 21 and 32, respectively. The guide spacer 14 and the guide cover 16 are superimposed on each other and put on the mounting portion 21 on the left side.

The ejecting unit 35 is disposed so as to abut on a front face of the guide cover 16 on the left. The screws 24 and 24 are caused to penetrate the guide spacer 14 and the guide cover 16 from behind the base 7, and the screws 24 and 24 are screwed into a frame 37 of the ejecting unit 35. Thereby, the ejecting unit 35 uses the guide cover 16 as a plate to be mounted and fixed on the base 7.

Simultaneously with fixation of the ejecting unit 35, the guide spacer 14 and the guide cover 17 are integrally fastened and fixed on the base 7. Through holes 22, 22, 33, 33, 34, and 34 penetrated by the screws 24 and 24 are provided in the base, guide spacer 14, and the guide cover 16, respectively. Screw holes 45 and 45 into which the screws 24 and 24 are screwed are formed in the frame 37 of the ejecting unit 35.

Incidentally, when a disk is dispensed leftward, the guide spacer 14 is reversed and mounted on the mounting portion 32 on the right side. A guide cover 16M (see FIG. 5 and the like) which is another member to be exchanged with the guide cover 16 is mounted.

The guide cover 16 is put on distal end portions of the respective support plates 9 and 9 and the spacers 8*a* and 8*b* at its lower end portion. The guide cover 16 is screwed on the base 7 by screws 90 and 90 penetrating the support plates 9 and 9 and the spacers 8*a* and 8*b*. In the guide cover, one through hole 91 of the through holes is inserted by the screws 90 and 90 is a circular hole, but the other through hole 92 on the right is a horizontally-elongated hole. This is because, when width adjustment is performed by moving the right spacer 8*b* with respect to the left spacer 8*a* so as to be capable of using disks having different diameters, the screw 90 can be inserted and screwed according to the position of the right spacer 8*b*.

Since the distal end portions of the support plates 9 and 9 on which a lower end portion of the guide cover 16 is placed are different in level from the spacers 8*a* and 8*b*, the lower end portion is formed into a stepped portion shape 16*p* so as to conform with the shape of the mounting portion, and so that the guide cover 16 can be firmly fixed on the support plates 9 and 9 and the spacers 8*a* and 8*b*. By screwing screws 68 and 68 into a bracket 63 holding a dispensation detecting sensor 36 (described later), an upper end portion of the guide cover 16 and an upper end portion of the guide spacer 14 are integrally fastened and fixed on the base 7.

In the base 7, the guide spacer 14, and the guide cover 16, horizontally-elongated holes 73, 75, and 76 are formed on portions inserted with the screws 68 and 68, respectively. A mounting portion of the dispensation detecting sensor 36 is adjustable within a range of these elongated holes 73, 75, and 76 so as to be capable of using disks having different diameters. Finally, the rightward dispensation guide 15 is mounted and fixed on the base 7 by a screw 25. Thereby, the guide spacer 14, the guide cover 16, and the rightward dispensation guide 15 are integrally mounted on the base 7.

The rightward exit path 12R is a space extending rightward and having a rectangular shape in section surrounded by the base 7, the guide spacer 14, and the guide cover 16, and the rightward dispensation guide 15. There is a dispensing opening at a forward end of the exit path 12R.

A leading disk 3 entering the exit path 12R from the guide path 6 is guided rightward on the exit path 12R by the rightward guide edge 13 of the guide spacer 14. When the guide spacer 14 is mounted on the right side of the base 7, the guide edge 13 of the guide spacer 14 faces left and guides the disk 3 leftward.

The ejecting unit 35 for ejecting or flipping out the disk 3 in a rightward direction and the dispensation detecting sensor 36 for detecting the disk 3 dispensed are mounted on the exit path 12R having the above-described structure. The ejecting unit 35 will be first explained. The ejecting unit 35 is disposed at an exit 6E of the guide path 6 while being relatively lopsided with respect to a center line of the guide path 6, and the ejecting unit 35 has a flipping roller 38 as a dispensing member biased so as to approach the guide path 6.

More specifically, the ejecting unit 35 is composed of an approximately-L-shape frame 37 for mounting a part, the afore-mentioned flipping roller 38 which resiliently comes in contact with an outer periphery of the disk 3 pushed up on the guide path 6 to enter the exit path 12, a pivoting lever 39 attached with the flipping roller rotatably at a distal end of a shaft thereof, a helical spring 40 biasing the pivoting lever 39 to the side of the guide path 6 such that the flipping roller 38 fronts the exit 12E, and a stopper 101 for the flipping roller 38 to receive and hold the pivoting lever 39 at a static position fronting the exit 6E of the guide path 6.

Incidentally, the stopper 101 is bent horizontally to form a right angle with the frame 37, and a cushioning member 102 such as a rubber member is disposed on an upper face of the stopper 101. The helical spring 40 is wound around a pivoting shaft 39*p* of the pivoting lever 39, one end of the helical spring 40 is caught in a groove hole of a catching metal part 104 bent horizontally so as to form a right angle with the frame 37, and the other end thereof is caught in a catching hole in the pivoting lever 39, thereby the helical spring 40 biases the pivoting lever 39 constantly in a direction of the guide path 6 (clockwise direction).

Then, the flipping roller 38 is exposed at the exit path 12 via an elongated hole for the flipping roller 42 formed on the base extension portion 7D and an arc-shaped elongated hole for the flipping roller 43 formed on the guide cover 16.

The ejecting unit 35 is mounted and fixed on the base 7 in a state in which the ejecting unit 35 is mounted on the front face of the guide cover 16 by screwing the screws 24 and 24 to penetrate the guide spacer 14 and the guide cover 16 which are superimposed on the base 7 from behind the base on the frame 37. When the ejecting unit 35 is fixed, the guide cover 16 and the guide spacer 14 are sandwiched and fixed between the frame 37 of the ejecting unit 35 and the base 7 to be integrated with the base 7.

Curved guide hole edges 45 and 46 conforming to each other are formed at left side edges of the respective elongated holes for the flipping roller 42 and 43 on the side of the guide cover and on the side of the base which the flipping roller fronts. The flipping roller 38 uses both the guide hole edges 45 and 46 of an aperture at a discharge position of the base plate 7 as guides to move inside the elongated holes 42 and 43.

Figure 6:
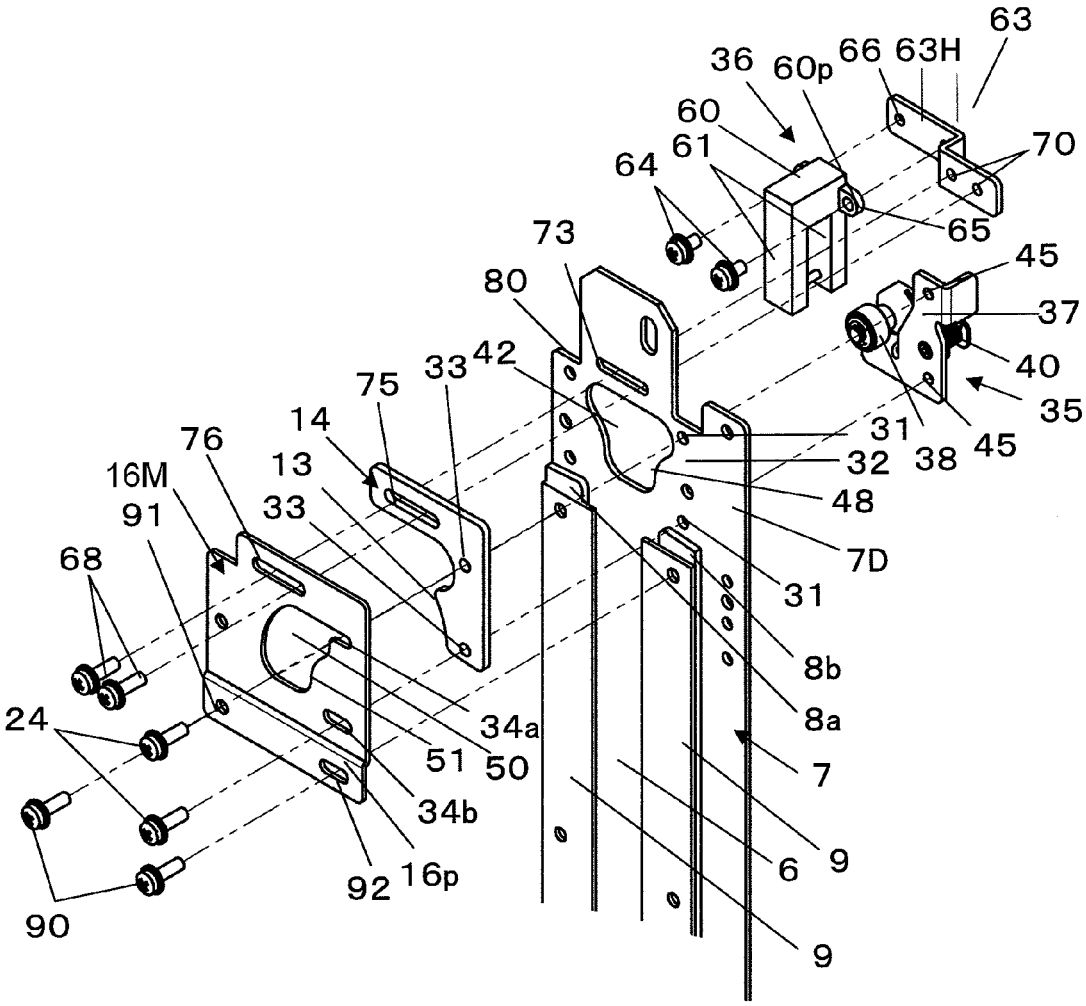
FIG. 6 is an exploded perspective view of the disk dispensing apparatus having a configuration where a disk is dispensed from a right-facing exit path.
Figure 7:
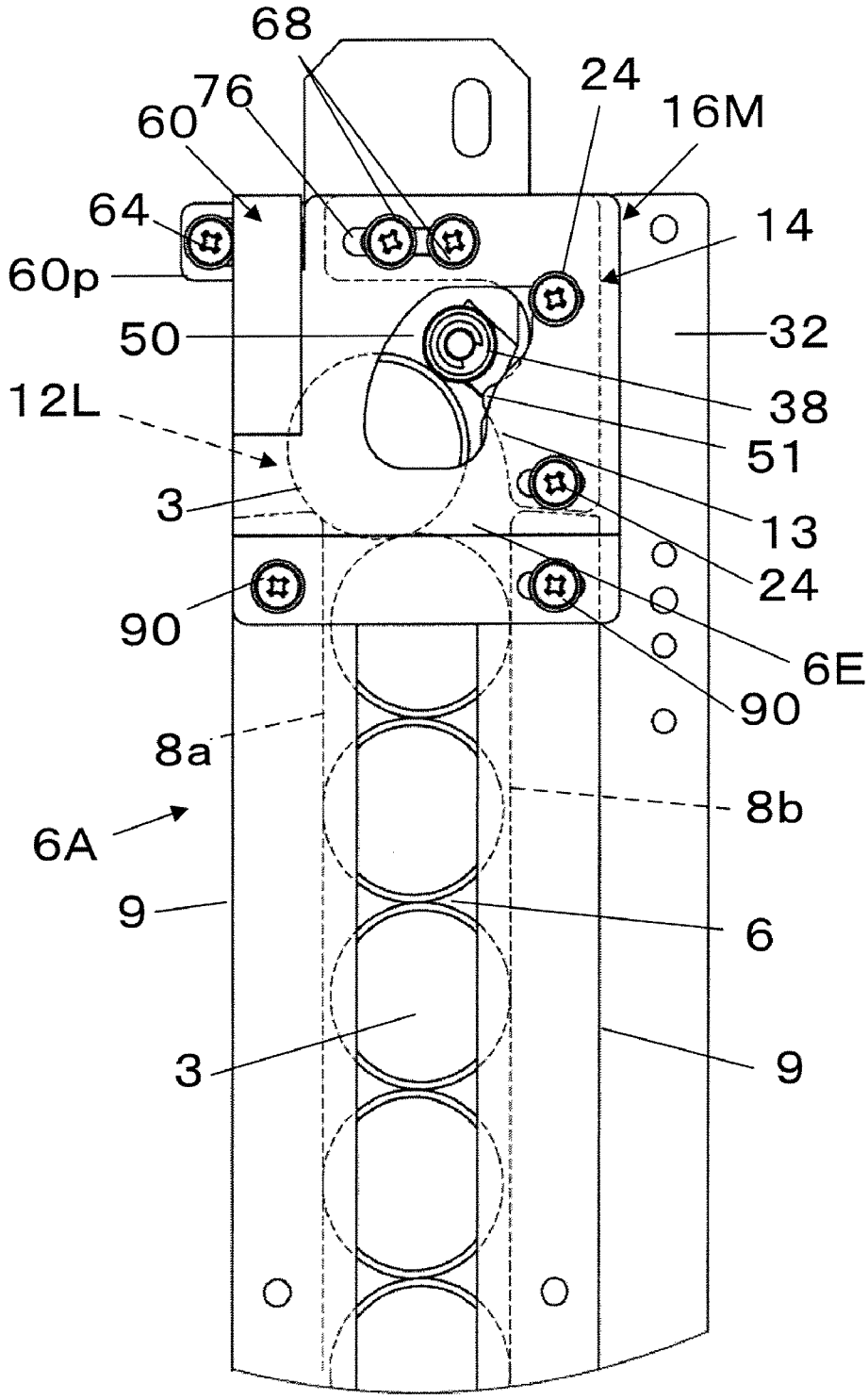
FIG. 7 is a front view of the disk dispensing apparatus in FIG. 6.

Incidentally, a curved guide hole edge 48 is formed at a right side edge of the elongated hole for the flipping roller 42 on the side of the base. This guide hole edge 48 takes a rightward dispensation aspect, and the guide hole edge 48 conforms with a curved right guide hole edge 51 formed at a right side edge of an elongated hole for the flipping roller 50 opened on the guide cover 16M when the guide cover 16 is exchanged with another guide cover 16M and the guide cover 16M is mounted, as shown in FIG. 6 and the like.

Figure 2:
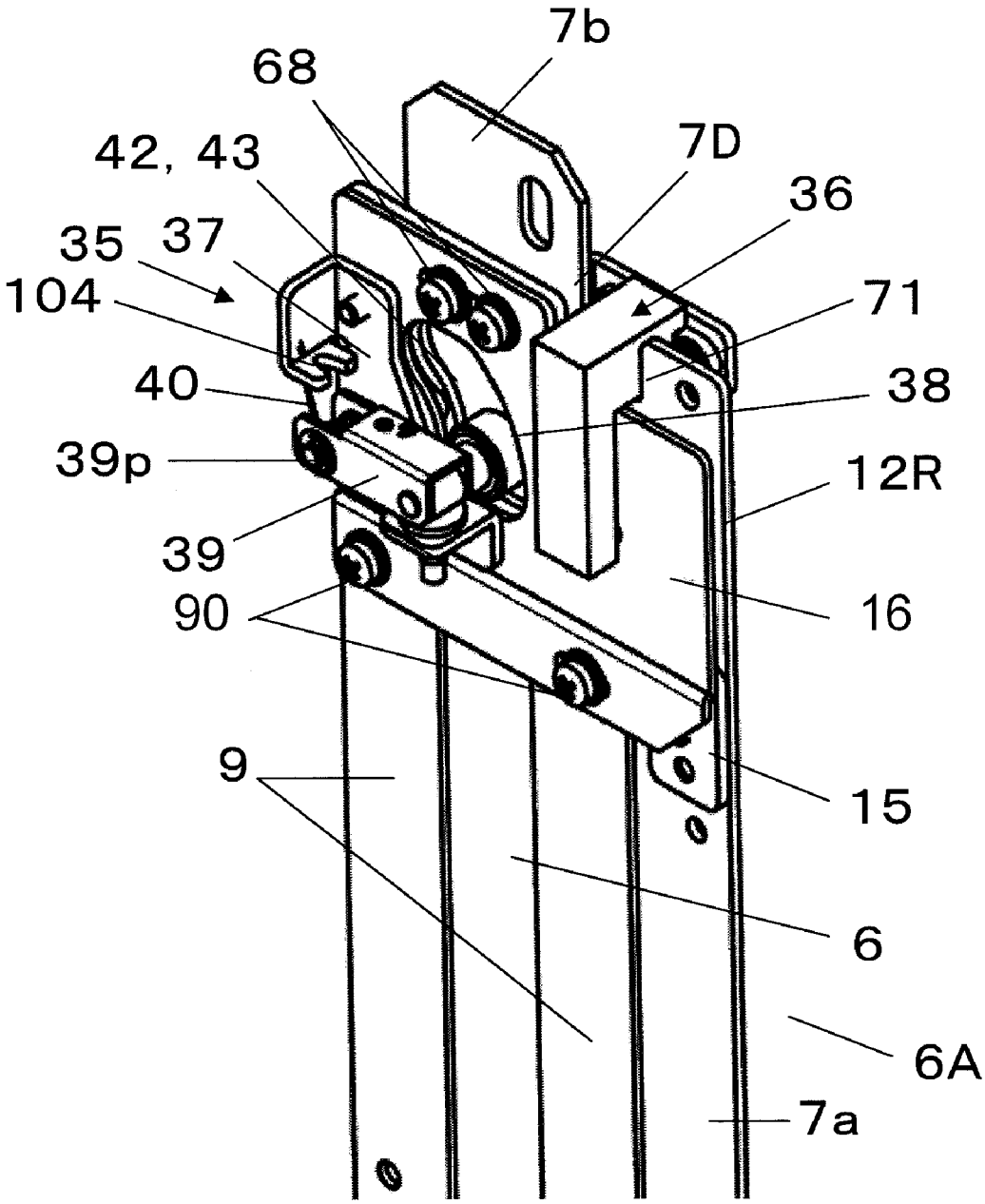
FIG. 2 is a perspective front view of the disk dispensing apparatus.

The dispensation detecting sensor 36 is disposed at a position just before the dispensing opening so as to extend across the exit path 12 R, as shown in FIG. 2. The dispensation detecting sensor 36 is provided with a channel-shaped resin outer case 60, and the dispensation detecting sensor 36 is an optical detecting sensor having such a structure that a light-emitting element such as an LED is incorporated in one of two columnar portions 61 and 61 of the outer case 60 and a light-receiving element is incorporated in the other columnar portion 61, where disks dispensed are detected one by one by a detecting signal outputted by interrupting a light path when the disks 3 pass through the exit path 12R positioned between the columnar portions 61 and 61.

The dispensation detecting sensor 36 is first screwed on a sensor holder portion 63H of the crank-shaped bracket 63 by screws 64 and 64. The dispensation detecting sensor 36 has mounting tabs 60*p* and 60*p* on the right and left of an upper end portion of the outer case 60. The screws 64 and 64 are screwed into screw holes 66 and 66 of the bracket 63 from through holes 65 and 65 of the mounting tabs 60*p* and 60*p* to mount the dispensation detecting sensor 36. Thereafter, the screws 68 and 68 are caused to penetrate the horizontally-elongated holes 73, 75, and 76 of the guide cover 16 and the guide spacer 14 from the front side of the base 7 are screwed into screw holes 70 and 70 of the bracket 63 to fix the bracket 63 on the base. Thereby, the dispensation detecting sensor 36 is mounted and fixed on the base 7.

At this time, by engaging the dispensation sensor 36 with a notched portion 71 provided on an upper end portion of the base extension portion 7D, the dispensation detecting sensor 36 can be jointed temporally. The dispensation detecting sensor 36 is jointed temporally through fitting of connecting portions of the bifurcated columnar portions 61 and 61 thereof. It is preferable that the notched portion 71 has a slightly-wider notch width such that the dispensation detecting sensor 36 can move laterally along the base 7 to a certain extent so that setting to a true position where the dispensation detecting sensor 36 performs detecting operation correctly can be adjusted.

A position of the dispensation detecting sensor 36 is adjustable within a range of an elongated hole 73 of the base extension portion 7D positioned in an area on which the bracket 63 is put, and the respective elongated holes 75 and 76 of the guide spacer 14 and the guide cover 16. The notched portion 71, an elongated hole 73, and the like constitute a mounting portion of the dispensation detecting sensor 36.

In the base extension portion 7D, a catching step portion 80 is formed at a position opposite to the notched portion 71. The catching step portion 80 can temporally join the dispensation detecting sensor 36 which has been repositioned from the right side of the base 7 to the left side thereof when an exit path 12L of leftward dispensation is adopted. The catching step portion 80, the horizontally-elongated hole 73, and the like constitute a mounting portion for leftward dispensation of the dispensation detecting sensor 36 at this time.

In this manner, such parts as the guide spacer 14, the guide cover 16, and the rightward dispensation guide 15 are integrated with the base 7 to form a path, and the ejecting unit 35 and the dispensation detecting sensor 36 are mounted on the path portion to form the exit path 12 for rightward dispensation.

Figure 5:
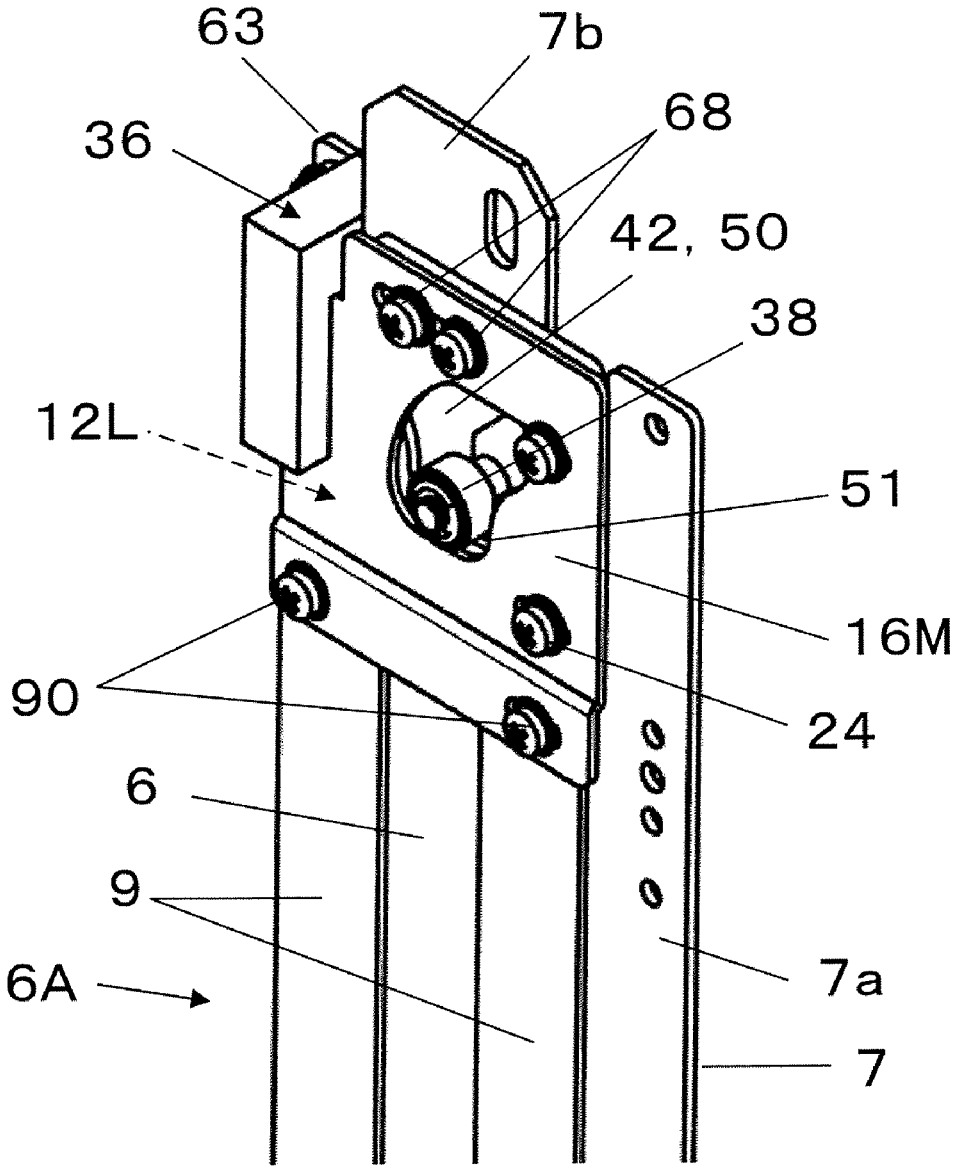
FIG. 5 is a perspective front view of the disk dispensing apparatus having a configuration where a disk is dispensed from a left-facing exit path.

A finished structure is shown in FIG. 2 and FIG. 5, the ejecting unit 35 is disposed on the front side with respect to the base 7, and the dispensation detecting sensor 36 is mounted on the mounting portion on the back side with respect to the base 7.

Figure 4:
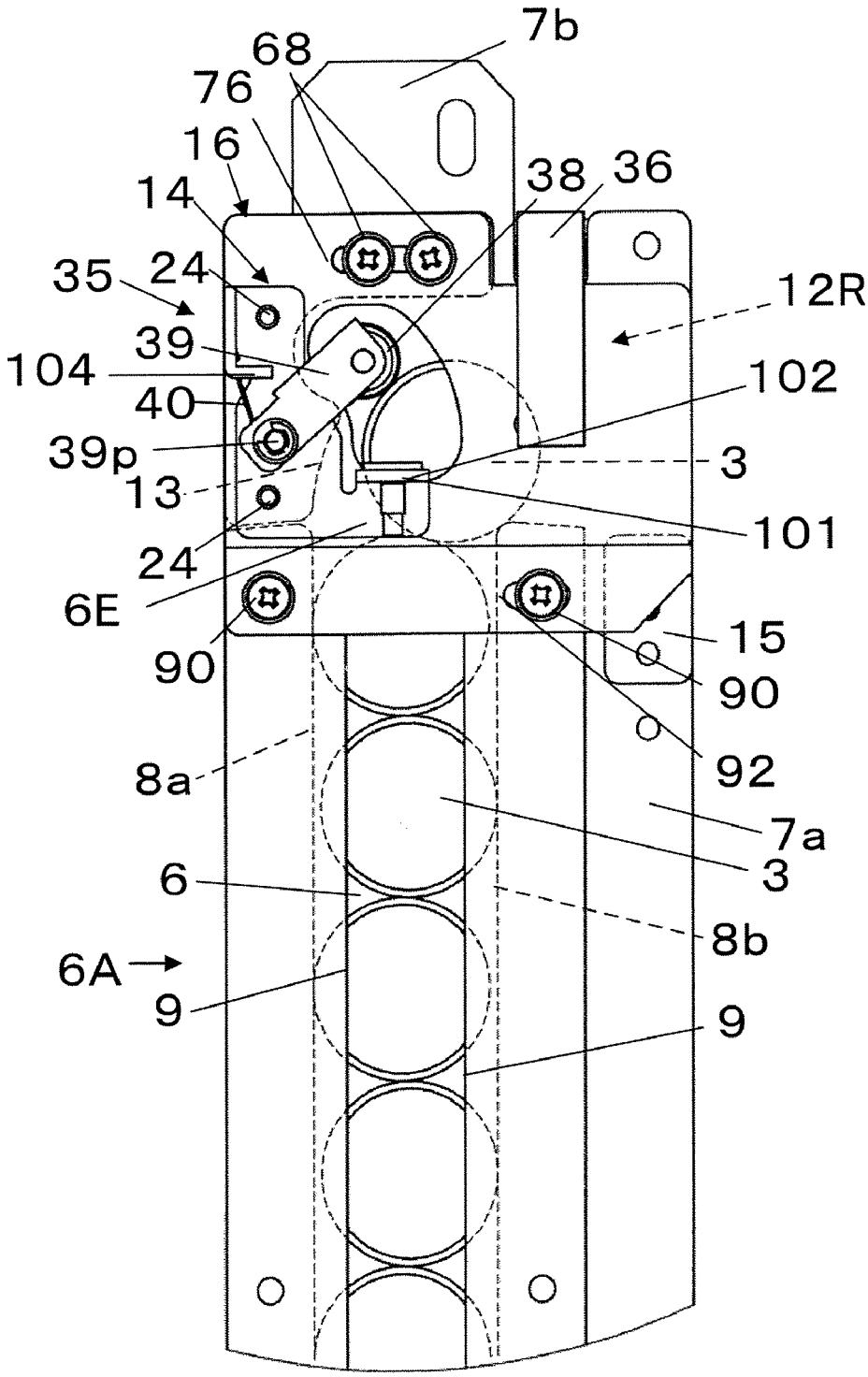
FIG. 4 is a front view of the disk dispensing apparatus in FIG. 3.

In this case, as shown in FIG. 4, the disk dispensing apparatus is configured such that the pivoting lever 39 and the dispensation detecting sensor 36, which are components of the disk dispensing apparatus, are positioned to be separate from each other. Therefore, operation of the pivoting lever 39 which pivots in conjunction with the disk dispensation does not influence a detecting operation of the dispensation detecting sensor 36. In other words, even such a standby state that the pivoting lever 39 is slightly pushed upward, as shown in FIG. 4, due to disk size changes so that a position of a leading disk on the guide path 6 changes is not out of relation to detection of the dispensation detecting sensor. Therefore, the disk dispensing apparatus, in which a length of the guide path is not required to be changed even when a disk size is changed, can be obtained.

The ejecting unit 35 is disposed such that a pivoting shaft 39*a* of the pivoting lever 39 is positioned on an extended line of the left spacer 8*a*, and the dispensation detecting sensor 36 is positioned on an extended line of the right spacer 8*b* so that both of the parts do not protrude from the extension portion of the base. By adopting such a structure for allowing setting of these parts in an area within a size (a width area in a lateral direction) of the guide path 6, the whole of the disk dispensing apparatus can be made compact.

Incidentally, as the base extension portion 7D at this time, an aspect which does not have a side portion 7*b* on which the rightward dispensation guide 15 is mounted, or an aspect which does not have a distal end portion for connection 7*c* for incorporating the dispensing apparatus into a casing for a game machine or the like is also adopted sufficiently.

Next, an assembly in a case of changing the exit path 12R with the exit path 12L for leftward dispensation will be explained with reference to FIG. 5 to FIG. 7, and FIG. 3 showing the rightward specification of the aforementioned embodiment.

In this case, the flipping mechanism 35, the dispensation detecting sensor 36, the guide spacer 14, the bracket 63, the plurality of screws 24, 64, 90, and 91, and the base 7 are also used for leftward dispensation. Incidentally, as for the base 7, when a width of the guide path 6 is changed according to a change of a disk diameter, the base 7 may be exchanged with another one. In this embodiment, the base 7 is also shared.

Figure 3:
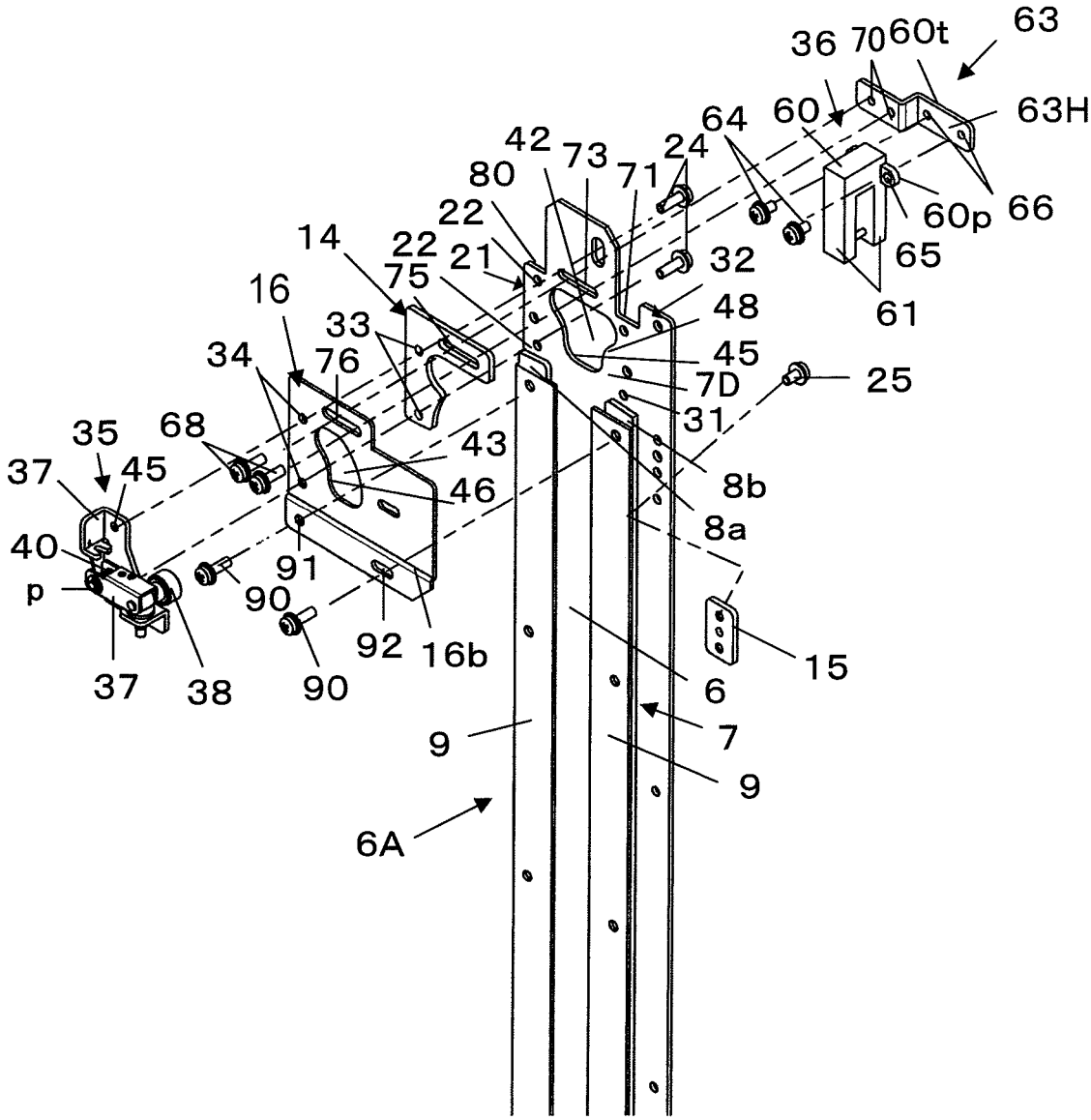
FIG. 3 is an exploded perspective view of the disk dispensing apparatus having a configuration where a disk is dispensed from a right-facing exit path.

When this assembly is adopted, the guide spacer 14, the bracket 63, and the ejecting unit 35 of the above-described shared parts, except for the base 7*a* and the dispensation detecting sensor 36 are caracoled to reverse the right and left sides or caracoled to reverse the upper and lower sides so that such a state as shown in FIG. 6 is obtained from a state shown in FIG. 3.

The guide spacer 14 is first caracoled to reverse the right and left sides, and positioned on the mounting portion 32 on the right side of the base 7 from the mounting portion 21 on the left side thereof where the guide spacer 14 is positioned for rightward dispensation. In this case, the guide spacer 14 is positioned symmetrically with respect to the center line of the guide path 6 when a dispensing direction is switched between the left and the right. Therefore, the guide edge 13 of the guide spacer 14 faces leftward, so that it becomes possible to guide the disk 3 leftward. Since the guide spacer 14 for rightward dispensation can be used as it is, the parts can be shared.

The guide cover 16M which is another member having an elongated hole for the flipping roller 50 is positioned in front of the guide spacer 14 in a corresponding manner. The curved guide hole edge 51 conforming with the right guide hole edge 48 of an elongated hole for the flipping roller 42 on the side of the base is formed at the right side edge of an elongated hole for the flipping roller 50.

The ejecting unit 35 is caracoled with respect to the base 7. The ejecting unit 35 is positioned on the side of the mounting portion 32 on the right side of the back face of the base 7 in a corresponding manner, and the frame 37 thereof is put on the base 7.

The two upper and lower screws 24 and 24 are caused to penetrate the guide spacer 14 and further the base 7 from the guide cover 16 to be screwed into the frame 37 of the ejecting unit 35. Thereby, the ejecting unit 35 is mounted and fixed on the mounting portion 32 on the right side of the base 7. The guide cover 16 and the guide spacer 14 are mounted and fixed integrally on the base 7.

The flipping roller 38 is exposed in the exit path 12L from an elongated hole for the flipping roller 42 positioned on the base extension portion 7D and an elongated hole for the flipping roller 50 of the guide cover 16M. In this manner, since the ejecting unit 35 for rightward dispensation can be used and mounted on the base 7, the parts can be shared.

Incidentally, in the guide cover 16M, by using an elongated groove hole 34*a* formed at the upper edge of an elongated hole for the flipping roller 50 and a horizontally-elongated hole 34*b* below an elongated hole for the flipping roller 50 as holes into which the screws 24 and 24 are inserted, the mounting position of the ejecting unit 35 can be adjusted within a range of these elongated holes 34*a* and 34*b* when the adjustment of the mounting position of the ejecting unit 35 is required according to an exchange of the base 7 so as to be capable of using disks having different diameters. In the guide cover 16M, a lower edge portion of the guide cover 16 is screwed on the base 7 by the screws 90 and 90 penetrating the support plates 9 and 9 and the spacers 8*a* and 8*b*.

The bracket 63, to be mounted with the dispensation detecting sensor 36, is caracoled vertically, and the dispensation detecting sensor 36 is screwed and mounted on the sensor holder portion 63H positioned on the left of the bracket 63 by the screws 64 and 64. Since the screws 64 and 64 for rightward dispensation are used as is, the parts are shared. The dispensation detecting sensor 36 is caught on the catching step portion 80 on the left side of the base 7 to be positioned.

After positioning, the screws 68 and 68 are caused to pass through the respective elongated holes 76, 75, 73 of the guide cover 16M, the guide spacer 14, the base 7 to be screwed into the screw holes 70 and 70 of the bracket 63 put on the base 7. Thereby, the dispensation detecting sensor 36 is repositioned from the right side to the left side of the base 7 to be mounted and fixed. Simultaneously, the upper end portions of the guide cover 16 and the guide space 14 are fastened and fixed integrally. Since the dispensation detecting sensor 36 for leftward dispensation can also be used for rightward dispensation as it is, it is economical.

In this manner, the exit path 12L for leftward dispensation is finished. Even if the exit path 12R is exchanged with the exit path 12L for leftward dispensation, almost all parts for rightward dispensation can be shared. Therefore, a lesser number of parts are required, and the dispensing apparatus can be modified and formed inexpensively. Since assembling can be performed in an approximately similar manner in both rightward and leftward dispensations, the assembling work is easy.

Appearance of a finished structure is shown in FIG. 5, and such a structure is obtained that the ejecting unit 35 is disposed on the back side with respect to the base 7, and the dispensation detecting sensor 36 is positioned on the left side with respect to the base 7.

The operation of the dispensing apparatus having the above-described structure will be explained. Since the same dispensing method is adopted even if a dispensing direction is switched between the right direction and the left direction, the disk dispensing apparatus for rightward dispensation will be explained with reference to FIG. 1 and FIG. 4.

The disks 3 are sent to the guide path 6 by driving the hopper 1 which is the sending apparatus, and these disks 3 move upward on the guide path 6 in a continuous manner to be discharged from the distal end of the guide path 6 to the exit path 12R.

The disk 3 which has entered the exit path 12R is guided while facing right on the guide edge 13 of the guide spacer 14, and simultaneously the disk 3 comes in contact with the flipping roller 38 and pushes up the pivoting lever 39 of the ejecting unit 35, and also pushes up the flipping roller 38 obliquely leftward in the elongated holes for the flipping roller 42 and 43 against resilient force of the spring 40 to move the flipping roller 38.

After pushing up the pivoting lever 39 to the maximum when the greatest diameter portion of the disk 3 passes, the disk 3 is flipped out when the flipping roller pivots to return downward due to the resilient force of the spring 40. The pivoting lever 39 which has pivoted to return hits on the stopper 101 at its lower end portion to be prevented from further pivoting, and the pivoting lever 39 is held at a standby position where the flipping roller 38 is caused to face the exit 6E of the guide path 6.

The disk 3 is dispensed from the rightward dispensing opening through the exit path 12R due to its momentum. The disk 3 is detected by the dispensation detecting sensor 36 just after being flipped by the flipping roller 38, and used for counting the total dispensed number.

After a predetermined number is counted, the sending apparatus is stopped. In the above manner, the disk 3 is dispensed rightward via the guide path 6 and the exit path 12R.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A disk dispensing apparatus which aligns and guides disks sent from a hopper on a guide path, and dispenses the disks laterally at a discharge position from a distal end of the guide path, comprising:

a rectangular base extending vertically upward;

a pair of spacers located in parallel at a predetermined distance on the rectangular base, at least one of the spacers is mounted to enable adjustments away from the other spacer;

a pair of support plates, each located on each spacer at a predetermined distance narrower than the spacers, at least one of the support plates is movable with regard to the adjustable spacer;

a guiding path constituted by the rectangular base, the spacers and the support plates for extending upwards;

an inverted L shaped guide spacer, a vertical part of the L shaped guide spacer is located at an extending line disposed at an upper end portion of one of the spacers;

a horizontal part of the L shaped guide spacer provides an exit path together with the spacers;

an elongated hole of an inverted triangle shape is located beside an extension of the guiding path along the rectangular base;

an ejecting unit includes a frame, a pivoting shaft fixed to the frame, a pivoting lever pivotable on the pivoting shaft, and a flipping roller which rotates on one end of pivoting lever;

a first mounting portion is located on an extended line of one of the support plates, on the rectangular base for attaching the frame from a front side of the rectangular base;

a second mounting portion is located on an extended line of one of the support plates, on the rectangular base and attaching the frame from a rear side of the rectangular base;

a crank-shaped bracket is configured for attachment to selectively the front side and the rear side of the rectangular base;

a horizontally-elongated hole is formed on the rectangular base for attachment of a crank-shaped bracket one of the front and the rear side of the rectangular base; and a dispensation detecting sensor is attached to the crank-shaped bracket.

2. The disk dispensing apparatus according to claim 1, wherein the ejecting unit is positioned on the rear side of the extension portion of the guide path.

3. The disk dispensing apparatus of claim 1 wherein a designation detecting sensor is mounted in a U-shaped housing configured to pass a disk through the U-shaped housing and a stepped shape bracket configured to position a dispensation detecting sensor in the disk path on either side of a lateral discharge position.

4. In a coin dispensing apparatus which sequentially delivers coins to a discharge position, the improvement comprising:

an adjustable guide path unit that can transport coins of different sizes including a base member, support plates defining a transit opening for a coin, the base member extending beyond the support plates at a discharge position with an aperture and a reversible guide spacer member that is mounted over the base member to enable one of a discharge of coins to either a first side and a second side 180π opposite to the first side at the discharge position; and an ejector unit removably mounted on the adjustable guide path unit, the ejector unit having a flipping roller that operatively interfaces with the aperture for propelling coins at the discharge position, wherein the base member has, adjacent the aperture, mounting holes that enable the ejector unit to be movable between a first location on the first side of the guide path and a second different location on the second side of the guide path.

5. The coin dispensing apparatus of claim 4 further including a guide cover member positioned over the guide spacer member.

6. The coin dispensing apparatus of claim 4 wherein the dispensation detecting sensor is mounted in a U-shaped housing and a stepped shape bracket is configured to position the dispensation detecting sensor in the coin path at either the first side or the second side.

7. A disk dispensing apparatus which aligns and guides disks send from a hopper on a guide path, and dispenses the disks laterally at a discharge position from a distal end of the guide path, comprising:

a guide member removably disposed on a distal end portion of the guide path, which has a guiding face which guides a disk laterally;

a disk ejecting unit removably positioned at an exit of the guide path; and a dispensation detecting sensor, removably mounted adjacent the exit of the guide path, which detects a disk flipped out by the ejecting unit, wherein separate mounting portions for the guide member, the ejecting unit, and the dispensation detecting sensor are provided respectively on the right and left side of an extension portion of the guide path to enable a re-location of the guide member, disk ejecting member and dispensation detecting sensor to alter the direction of lateral dispensation of disks, including a reversible guide spacer member that is mounted across the extension portion to enable one of a discharge of disks to either a first side and a second side, 180° opposite to the first side, at the discharge position.

8. The disk dispensing apparatus according to claim 7, wherein the ejecting unit is positioned on the right side or the back rear side of the extension portion of the guide path.

9. The disk dispensing apparatus of claim 7 further including a guide cover member positioned over the reversible guide spacer member.

10. The coin dispensing apparatus of claim 9 wherein the extension portion has mounting holes that enable the disk ejecting unit to be operatively mounted to discharge coins to either the first side or the second side.

11. The coin dispensing apparatus of claim 7 wherein the dispensation detecting sensor is mounted in a U-shaped housing configured to pass a coin through the U-shaped housing with mounting portions to enable mounting at either the right or left side of the extension of the guide path.

* * * * *